US007441946B2

(12) United States Patent
Bonadei

(10) Patent No.: US 7,441,946 B2
(45) Date of Patent: Oct. 28, 2008

(54) BAND-SHAPED STRAP, PARTICULARLY WATCH STRAP, ABLE TO BE SHORTENED BY CUTTING

(75) Inventor: Silvano Bonadei, Courroux (CH)

(73) Assignee: The Swatch Group Management Services AG, Biel (CH)

( * ) Notice: Subject to any disclaimer, the term of this patent is extended or adjusted under 35 U.S.C. 154(b) by 113 days.

(21) Appl. No.: 10/563,839

(22) PCT Filed: Jul. 1, 2004

(86) PCT No.: PCT/EP2004/007135

§ 371 (c)(1),
(2), (4) Date: Jan. 9, 2006

(87) PCT Pub. No.: WO2005/002382

PCT Pub. Date: Jan. 13, 2005

(65) Prior Publication Data

US 2006/0144881 A1 Jul. 6, 2006

(30) Foreign Application Priority Data

Jul. 7, 2003 (EP) ..... 03015293

(51) Int. Cl.
*G04B 37/16* (2006.01)
*A44C 5/00* (2006.01)
*A44B 11/00* (2006.01)

(52) U.S. Cl. ..... 368/282; 24/16 PB; 24/68 E; 24/265 BC; 24/265 WS; 224/164; 224/267

(58) Field of Classification Search ..... 368/281, 368/282; 63/7, 21; 224/164, 267; 24/265 R, 24/68 E, 265 BC, 265 WS, 16 PB
See application file for complete search history.

(56) References Cited

U.S. PATENT DOCUMENTS 2,449,885 A * 9/1948 Domler ..... 224/164
4,288,892 A * 9/1981 Mardirossian ..... 24/307
4,303,109 A 12/1981 Cohen
4,406,043 A * 9/1983 Friedman ..... 24/171
4,470,174 A * 9/1984 Rhea ..... 24/68 E (Continued)

FOREIGN PATENT DOCUMENTS

CH 604 597 9/1978

(Continued)

OTHER PUBLICATIONS

International Search Report issued in corresponding application No. PCT/EP2004/007135 completed Oct. 26, 2004 and mailed Nov. 5, 2004.

*Primary Examiner*—V. W. Miska
*Assistant Examiner*—Jeanne-Marguerite Goodwi
(74) *Attorney, Agent, or Firm*—Griffin & Szipl, P.C.

(57) ABSTRACT

The watch strap includes a first strand provided with a buckle with a tongue and a second strand for engaging in the buckle. To allow a rough adjustment of the length of the strap, the first strand includes a plurality of transverse orifices and central holes which are distributed from its free end. It is thus possible to cut the strand on a section that passes through one of the central holes, then to fit the buckle and tongue onto the new free end of the strand. This strap can be manufactured in one size for all wrist sizes.

7 Claims, 1 Drawing Sheet

U.S. PATENT DOCUMENTS 4,706,857 A * 11/1987 Aellen et al. ..... 224/164
6,101,842 A * 8/2000 Delacretaz ..... 63/4
6,328,188 B1 * 12/2001 Boznos et al. ..... 224/175
6,339,848 B1 * 1/2002 Mayhood et al. ..... 2/338
6,839,916 B1 * 1/2005 Chen ..... 2/322
6,960,016 B2 * 11/2005 Apotheloz et al. ..... 368/282
2003/0233700 A1 * 12/2003 Cress ..... 2/338
2006/0124674 A1 * 6/2006 Chan ..... 224/164

FOREIGN PATENT DOCUMENTS

GB 2 126 649 A 3/1984

* cited by examiner

BAND-SHAPED STRAP, PARTICULARLY WATCH STRAP, ABLE TO BE SHORTENED BY CUTTING

This is a National Phase Application in the United States of International Patent Application No. PCT/EP2004/007135 filed Jul. 1, 2004, which claims priority on European Patent Application No. 03015293.8, filed Jul. 7, 2003. The entire disclosures of the above patent applications are hereby incorporated by reference.

BACKGROUND OF THE INVENTION

The present invention concerns a band-shaped strap, in particular, a watch strap, comprising at a first end a first strand provided with a buckle and tongue, and at a second end, a second strand with holes passing through its thickness to be attached in a removable manner to the first strand by engaging in the buckle, each strand being formed of a flexible continuous band, the buckle including two lateral branches each provided with a hole, a removable transverse bar whose ends are arranged to engage in holes in the branches, and a tongue having an eyelet part rotatably engaged on said bar, the first strand having an end orifice arranged transversely close to a free end of the strand, for receiving said bar of the buckle, and an end notch extending from said free part up to beyond the end orifice for receiving the eyelet part of the tongue.

Apart from straps and wristbands, this invention can be applied to any type of strap comprising a band one end of which is provided with a buckle and tongue, particularly belts, straps for luggage and similar straps.

The term "strand" is used here in the general sense for designating both the flexible end parts of a strap of this type, which have to be attached to each other by means of the buckle mounted on the first strand. Since the rest of the strap does not play any part in the present invention, it can have a different structure from that of the end strands and particularly be made of different materials. Moreover, the two strands can be separate elements connected to each other indirectly, for example by the watchcase if the strap is a watch strap.

The above preamble corresponds particularly to a conventional watch strap each strand of which is made of a continuous band of flexible material such as leather, a synthetic or textile material. This type of strap can be fitted to wrists of different sizes, but only to a limited extent. In fact, if the strap has to be able to fit both particularly large wrists as well as small wrists such as those of children, the second strand has to be very long and include a very long row of holes. If a strap that is too long is attached around a wrist of medium or small size, the end part of the second strand, passing beyond the buckle, will be particularly long and will inconvenience the user. Another drawback lies in the fact that the first strand, because of its fixed length, will determine a position for the buckle which will not necessarily be opposite the watch, but will depend upon the size of the wrist. These drawbacks lead to manufacturers usually offering wristbands without links in two or three different sizes, which not only complicates manufacture, but also stock management, distribution and sales. When the strands of the straps are parts made of moulded synthetic materials, making several moulds of different size considerably increases the manufacturing. cost.

CH Patent No. 604 597 discloses a method of securing the buckle to the first strap strand, which enables the strand to be shortened to a suitable length prior to securing the buckle by inserting an intermediate metal piece forming a loop, in which the bar of the buckle (which in this case is not of the type having a tongue) engages. The first strand of the strap includes a series of transverse grooves in its bottom face, whereas the intermediate piece in the shape of a clamp comprises ribs capable of engaging in two of the grooves. Thus the strand can be cut to the desired length, and then the intermediate piece is set in place by being engaged in the two grooves the closest to the cut end of the strand. A sleeve is slipped over the intermediate piece to hold it in place, and then the buckle can be mounted on the aforecited loop. This construction is relatively complicate and, in fact, it is intended for a metallic wristband provided with a clasp which does not use a buckle and tongue.

FR Patent Application NO 2 532 826 (=GB 2 126 649) concerns a modification of a conventional type buckle and tongue strap, consisting in providing only one hole in the second strand of the strap and adjusting the length of the strap by moving the position of the buckle and tongue on the first strand. The tongue is therefore not hinged on a removable bar, but on a central cross piece, which carries at its middle a reverse U-shaped support on which the tongue is hinged. The first strand of the strap includes a row of central holes in which the user can choose to insert the tongue and its U-shaped support to determine the desired position of the buckle along the strand.

Of course, with this arrangement, the user has to have several central holes on the first strand if he wishes to be able to adjust the length of the strap at any time. Consequently, the first strand generally passes through the entire length of the buckle, as does the second strand once it is engaged in the buckle. This large thickness of the strap in the entire buckle area is a drawback. Another drawback is that any adjustment of the length of the strap means moving the buckle by a manipulation that is not particularly easy.

SUMMARY OF THE INVENTION

The starting point of the present invention consists in using the conventional fastening system with a buckle and tongue on the first strand of the strap and a row of holes in the second strand, because this system is the easiest to manipulate to make a fine adjustment to the length of the strap each time it is used, but to make a rough adjustment initially if necessary, by shortening the first strand as a function of the size of the element it encircles. It thus becomes possible to manufacture straps such as wristbands in a single size, the largest, and to shorten the first strand by simple manipulations, able to be carried out by the salesperson or the user himself.

The invention therefore concerns a strap of the type indicated in the preamble, characterized in that the first strand includes a plurality of additional transverse orifices, distributed over a certain length of the strand from the end orifice and each associated with an elongated hole passing through the thickness of the strand and intersecting with the associated transverse orifice, such that the first strand can be shortened by cutting along a transverse section passing through any one of said elongated holes, the transverse orifice associated with the hole becoming a new end orifice for receiving said buckle bar. At the same time, since the cut passes through said elongated hole, it transforms the hole into an open notch, able to receive the eyelet part of the tongue.

Said associated transverse section can advantageously be marked by a groove on at least one face of the first strand and preferably on both faces. This enables a clean chamfered cut to be obtained along each face of the band-shaped strap.

The invention not only has the advantage of being able to offer straps in a single size for a wide range of widths for the elements to be encircled by such a strap, for example for all possible wrist sizes in the case of a wristband, but also the rough adjustment operation of cutting the first strand can easily be carried out by anyone and at any time, as will be seen hereinafter.

Other features and advantages will appear in the following description of a preferred embodiment of a watch strap according to the invention, given by way of non-limiting example with reference to the annexed drawings.

DETAILED DESCRIPTION OF THE INVENTION

Figure 1:
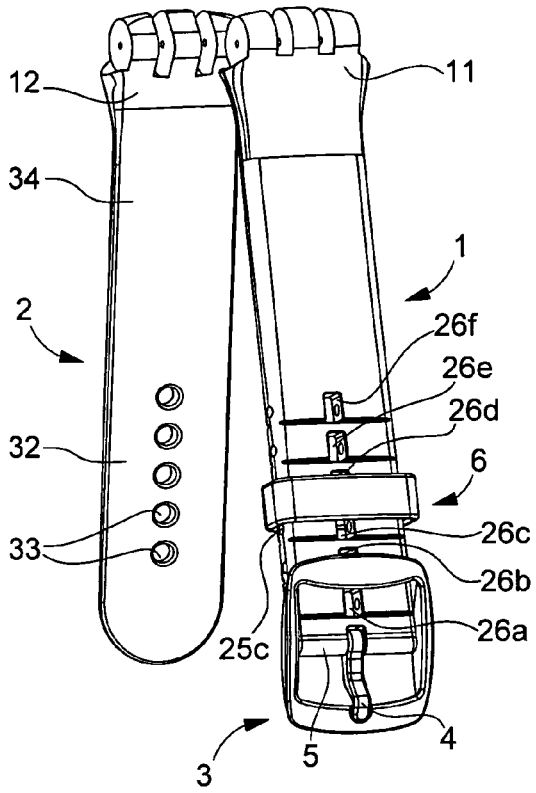
FIG. 1 shows in perspective the two strands of the strap, shown from above.
Figure 2:
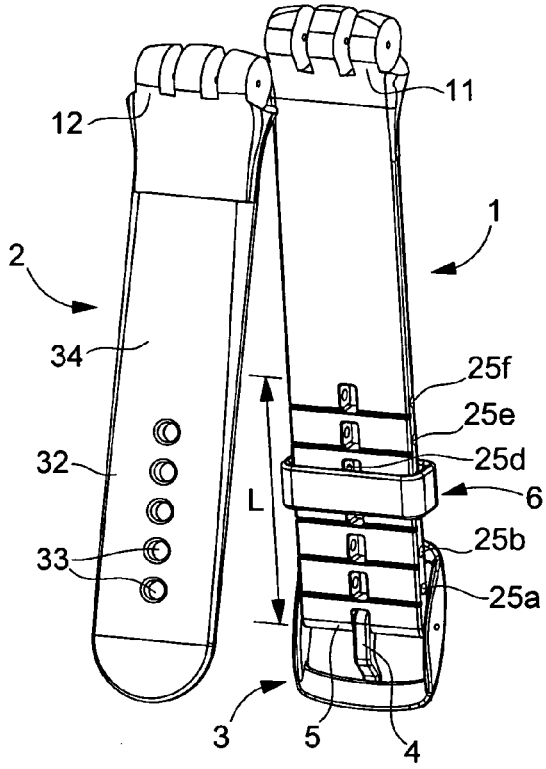
FIG. 2 shows in perspective the two strands of the strap, shown from below.

The watch strap shown in the drawings includes a first strand 1, a second strand 2, a buckle 3 with a tongue 4 mounted at one end 5 of the first strand, and a moving strap loop 6 threaded onto the first strand.

The first strand 1, second strand 2 and loop 6 of the strap are preferably parts made of relatively soft moulded synthetic material, for example polyurethane. The back end 11, 12 of each strand 1, 2 is arranged to be attached to a watchcase by means of a hinge pin, but any other method of attachment could be envisaged, including an embodiment wherein the two strands 1 and 2 form a single part which is threaded for example into two lugs of the watchcase. In such case, the term "strand" designates each of the two end parts of the strap.

Figure 3:
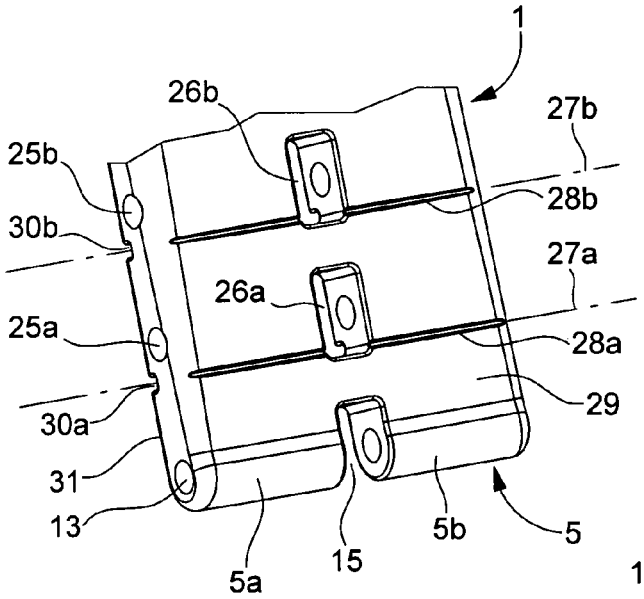
FIG. 3 is an enlarged perspective view of the end of the first strand.

As can be seen in particular in FIG. 3, the free end 5 of the first strand 1 includes, for mounting buckle 3, a substantially cylindrical end orifice 13, which passes through the entire width of strand 1 to receive a central bar 14 (FIG. 4) of buckle 3, and a central notch 15 for receiving an eyelet part 16 of tongue 4. The configuration of orifice 13 and notch 15 is entirely conventional, i.e. notch 15 has sufficient depth from end 5 of strand 1 to extend beyond orifice 13, the end of the strand being thus divided into two branches 5*a* and 5*b*, through both of which orifice 13 passes. Of course, if strand 1 were particularly wide, the buckle could include for example two tongues 4 and the end of strand 1 would also include two notches 15, which would then no longer be central.

Figure 4:
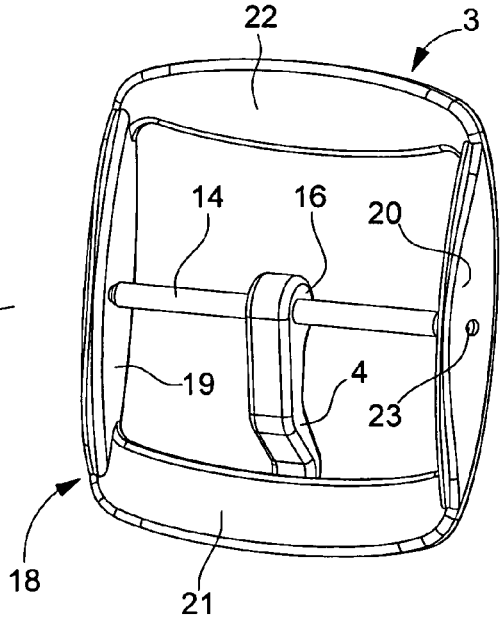
FIG. 4 is an enlarged perspective view of the bottom of the buckle.

Referring to FIG. 4, buckle 3 used in this example is made in an entirely conventional manner and includes an approximately rectangular frame 18 including two flat parallel lateral branches 19 and 20, connected at their ends by a front cross piece 21 and a back cross piece 22. The top face of front cross piece 21 preferably has a hollow portion which houses the tip of tongue 4. The eyelet part 16 of the tongue is rotatably engaged on bar 14, which is a conventional spring bar of the type used for attaching straps to a watchcase, the retractable tips of the bar being each engaged in a hole 23 of the corresponding branch 19 or 20, so that bar 14 and tongue 4 of the buckle can easily be mounted and removed.

Thus, in order to mount buckle 3 on end 5 of first strand 1, eyelet part 16 of tongue 4 is placed in notch 15, bar 14 is inserted through end orifice 13 and the tongue eyelet, then frame 18 of the buckle is placed such that its lateral branches 19 and 20 push back the spring tips of bar 14 until the latter engage in holes 23. To dismantle the buckle, one need only engage a pointed tool in one of holes 23 to push back the tip of bar 14 and thus release frame 18, then the bar and the tongue can be removed.

In order to allow a rough adjustment of the length of the strap and in particular first strand 1, the latter includes several additional transverse orifices 25*a* to 25*f*, similar to orifice 13, and a row of several holes intersecting with the transverse orifice associated therewith in the same way that notch 15 intersecting with end orifice 13. Each central hole 26*a* to 26*f* has an elongated shape, preferably rectangular, substantially the same size as notch 15, and it is aligned with the notch so that it can act in turn as the end notch if the strap is cut as will be described hereinafter.

A transverse cutting section is associated with each of transverse orifices 25*a* to 25*f* and passes through the corresponding central hole 26*a* to 26*f*. In FIG. 3, lines 27*a* and 27 represent two of these transverse sections provided for cutting. The position of these sections is indicated to the user by a small groove at 28*a*, 28*b* with a V-shaped profile on top face 29 of strand 1 and by a wider transverse groove 30*a*, 30*b* on bottom face 31 of the strand.

Preferably, the transverse orifices 25*a* to 25*f* and the associated cutting transverse orifices are regularly spaced along strand 1 over a length L from end 5, for example along a step of approximately 1 cm, which is ample for a rough adjustment of the length of the strap. Thus, if the first strand 1 as sold is too long for the user, particularly because the buckle 3 is not opposite the watchcase on the user's wrist, the user can easily dismantle buckle 3 as described hereinbefore, cut off a suitable length from the end of strand 1 using a knife, for example on transverse section 27*b* shown in FIG. 3, thus forming a new end of the strand in which central hole 26*b* is open and forms a new notch, similar to end notch 15, to receive the eyelet part 16 of tongue 4. Bar 14 of the buckle then only needs to be inserted into the new end orifice 25*b* and buckle frame 18 set in place as described hereinbefore.

In a conventional manner, the second strand 2 of the strap includes an end part 32, provided with a longitudinal row of holes 33 and to be engaged in buckle 3 to attach one strand to the other in a removable manner. As with a conventional watch strap, the user can choose the hole 33 in which tongue 4 will engage, which allows fine adjustment of the length of the strap in relation to the circumference of the wrist. Because of the rough adjustment made possible by shortening first strand 1, the row of holes 33 can be shorter than in a conventional strap. This means not only an advantage from the aesthetic point of view, but also leaves a greater length without any holes in zone 34 located between the back end 12 of the second strand and row of holes 33. Certain additional decorative or functional elements can thus be more easily placed in this zone 34, for example electric circuits cooperating with the circuits of an electronic watch.

The means allowing the length of first strand 1 to be adjusted, i.e. orifices 25*a* to 25*f*, holes 26*a* to 26*f* and grooves 28*a*, 28*b*, 30*a* and 30*b*, are particularly easy to make by moulding when the strand of the strap is a moulded synthetic part. However, similar means can also be achieved, particularly by cutting, in straps having a different structure, for example with a core made of synthetic or other material, covered with leather or textile on both faces.

It will also be noted that the strands made according to the present invention could form only the end parts of a strap the rest of which could have a different structure, for example a metallic structure or made of leather or textiles.

The invention claimed is:

1. A band-shaped strap including:

at a first end a first strand provided with a buckle and tongue and at a second end a second strand through the thickness of which holes pass, intended to be attached in a removable manner to the first strand by engaging in the buckle, each strand being formed of a continuous flexible band, the buckle including two lateral branches each provided with a hole, a removable transverse bar the ends of which are arranged for engaging in the holes of the branches, and a tongue having an eyelet part rotatably engaged on said bar, the first strand having an end orifice arranged transversely close to a free end of the strand, said end orifice extending in a plane parallel to that of the strand for receiving said bar, and an end notch extending from said free end to beyond the end orifice to receive the eyelet part of the tongue, wherein the first strand includes a plurality of additional transverse orifices distributed over a certain length of the strand from the end orifice and each associated with an elongated hole passing through the thickness of the strand and intersecting with the associated transverse orifice, such that the first strand can be shortened by cutting along a transverse section passing through any one of said elongated holes, the transverse orifice associated with the hole becoming a new end orifice for receiving said bar, and the elongated hole through which the cutting has been made becomes a new end notch for receiving the eyelet part of the tongue.

2. The strap according to claim 1, wherein said transverse section associated with each elongated hole is marked by a groove on at least one face of the first strand.

3. The strap according to claim 1, wherein each elongated hole extends from said associated transverse section to beyond the associated transverse orifice.

4. The strap according to claim 1, wherein the strands are made of synthetic material.

5. The strap according to claim 1, wherein the first strand is a moulded part.

6. The strap according to claim 1, wherein the strands are made of synthetic material comprising polyurethane.

7. The strap according to claim 1, wherein the strap is a watch strap.

* * * * *